US005408913A

United States Patent [19]

Hoshino

[11] Patent Number: 5,408,913

[45] Date of Patent: Apr. 25, 1995

[54] ADJUSTABLE SUPPORT LEGS FOR A BASS DRUM

[75] Inventor: Yoshiki Hoshino, Aichi, Japan

[73] Assignee: Hoshino Gakki Co., Ltd., Nagoya, Japan

[21] Appl. No.: 242,249

[22] Filed: May 13, 1994

[30] Foreign Application Priority Data

Dec. 27, 1993 [JP] Japan ..... 5-075504 U

[51] Int. Cl.[6] ..... G10D 13/02

[52] U.S. Cl. ..... 84/421; 403/97; 403/117; 403/104

[58] Field of Search ..... 84/411 R, 421; 403/97, 403/117, 103, 104, 106

[56] References Cited

U.S. PATENT DOCUMENTS

| | | | |
|---|---|---|---|
| 1,177,638 | 4/1916 | Larson et al. | 403/97 |
| 2,919,618 | 1/1960 | Slingerland | 84/421 |
| 3,129,937 | 6/1962 | Miller | 403/103 |
| 3,541,914 | 11/1970 | Thompson | 84/421 |
| 4,640,175 | 2/1987 | Hoshino | 84/421 |
| 4,869,147 | 9/1989 | Hoshino | 84/421 |

*Primary Examiner*—Michael L. Gellner
*Assistant Examiner*—Patrick J. Stanzions
*Attorney, Agent, or Firm*—Ostrolenk, Faber, Gerb & Soffen

[57] ABSTRACT

A support leg for a musical instrument bass drum including a base on the drum body having an annular gear surface, a leg pivotally supported to the base at the center of the gear surface, and gearing on the leg for meshing with the gear surface on the base for preventing swinging of the leg with respect to the base. A spring urges the base and leg apart to permit the leg to pivot. A bolt is tightened to move the gear surface and gearing into meshing. Cooperating stoppers on the base and the leg establish the use and nonuse swing positions of the leg with reference to the base. The support leg includes a main body and a leg that expands or contracts with reference to the body and a clamp for clamping the leg at a selected expanded position. A display on the main body displays the expanded position of the leg with respect to the body.

9 Claims, 9 Drawing Sheets

ADJUSTABLE SUPPORT LEGS FOR A BASS DRUM

BACKGROUND OF THE INVENTION

The invention relates to an adjustable support leg for a bass drum movable between use and non-use positions.

A support leg for a bass drum is used for stabilizing the main drum body while it is in use. A support leg is disposed at both the right and left bottom sides of the main body. Because a tom-tom drum is ordinarily installed at the top of the bass drum, there is need to securely hold the right and left support legs of the drum at a uniform length so that the drum set should not fall due to the weight of the tom-tom or due to drumming impact during a performance.

For known support legs for a bass drum, the length of each support leg is tentatively set. Then using observations from a distance, the lengths of the right and left legs are readjusted as the installation demands. However, such an adjusting method complicates the operation of the drum set and also might cause the performance to be done with the drum in an unstable condition, i.e., with the lengths of the right and left support legs being uneven.

Many support legs of this kind for a bass drum are stored when the drum is not being used and are then folded in a horizontal orientation to make it convenient for the drum to be carried around. A structure for freely changing over and rotating each support leg is known for holding the support leg sideways. In addition, a stopper is used for positioning the support leg between the use and storage conditions. The stopper protrudes outwardly in most cases, as disclosed in the Japanese Official Gazette of Utility Model Publication No. Sho 58-37101. An externally exposed stopper may ruin the outside appearance of the drum.

SUMMARY OF THE INVENTION

The invention provides a new support leg design wherein the lengths of the right and left support legs of the bass drum can be adjusted to the desired length in a single operation and with no possibility that the stopper for switching over from the use to the stored states of the support leg will be exposed outside.

The support leg for a bass drum is securely held in a freely expandable and contractable manner on a base that is fixed to the main body of the bass drum. The leg is freely rotatable to switch over between the leg use and stored positions. The base has an outwardly facing, annular ring gearing surface comprising a radial concave-convex part that has been formed on its outer surface. A first and a second stopper protrude outward and are located inside the annular gearing surface.

The leg comprises a main bar shaped body. A fitting surface of a cooperatingly shaped radial concave-convex shape that meshes with the gearing surface on the base is formed on the upper reverse side of the bar shaped body. A stopper on the inner side of the fitting surface is engageable with either the first or the second stopper protrusions of the base for defining the leg use and storage positions. A leg holding part on the main body securely holds the leg in a freely expanding and contracting manner with respect to the main body.

A display is provided on the leg holding part for displaying the expanded or contracted position of the leg, whereby the desired leg length can be set according to the indication on the display, rather than through trial and error repetition.

Other objects and features of the invention are explained below with reference to the accompanying drawings.

DESCRIPTION OF A PREFERRED EMBODIMENT

Figure 1:
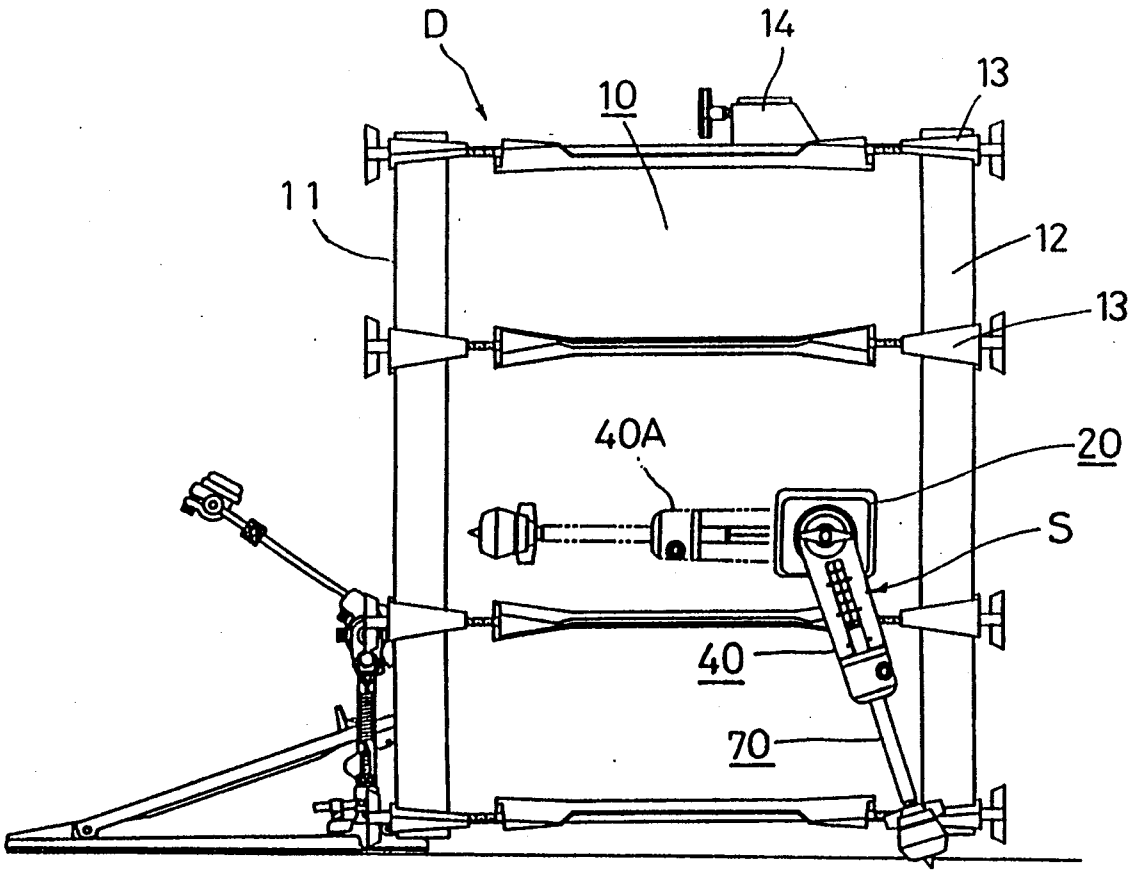
FIG. 1 is a side view of a drum body of a bass drum having a support leg and attachment of the invention.

FIG. 1 shows a base 20 for supporting a drum support leg assembly 40. The base is secured to the main body 10 of a bass drum D. The leg assembly 40 securely holds a leg body 70 in a freely expanding and contracting fashion and is also rotatable in a free switch-over manner between the leg use 40 and leg stored 40A positions.

At each end of the drum body 10, there is a drum head 11, which is held on by a drum hoop 12. The hoops in turn are each held on by lugs 13. A tom-tom drum holder base 14 is placed at the top of the drum body.

As shown in FIGS. 2 through 6, the base 20 comprises a base body 21, an annular gearing surface 25 on the outer surface of the base body 21, a first stopper protrusion 26 and a second stopper protrusion 27.

Figure 2:
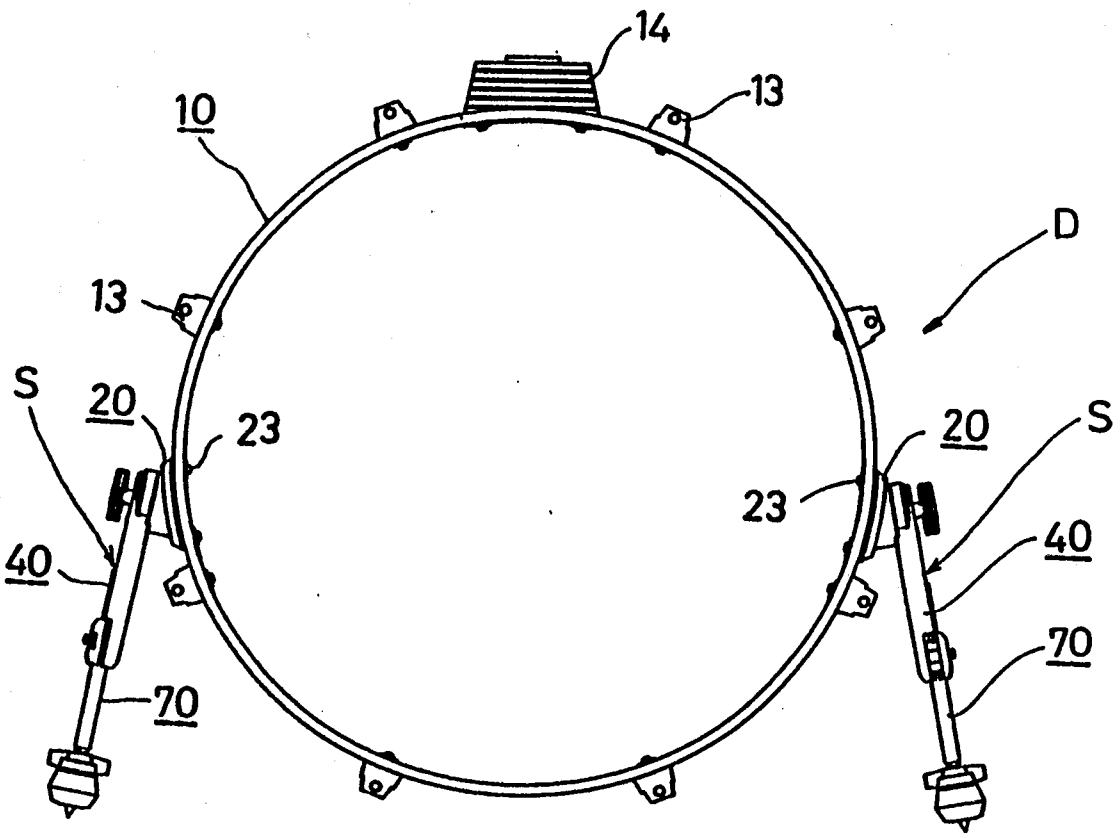
FIG. 2 is a front view of the drum showing the drum head and drum hoop removed.
Figure 4:
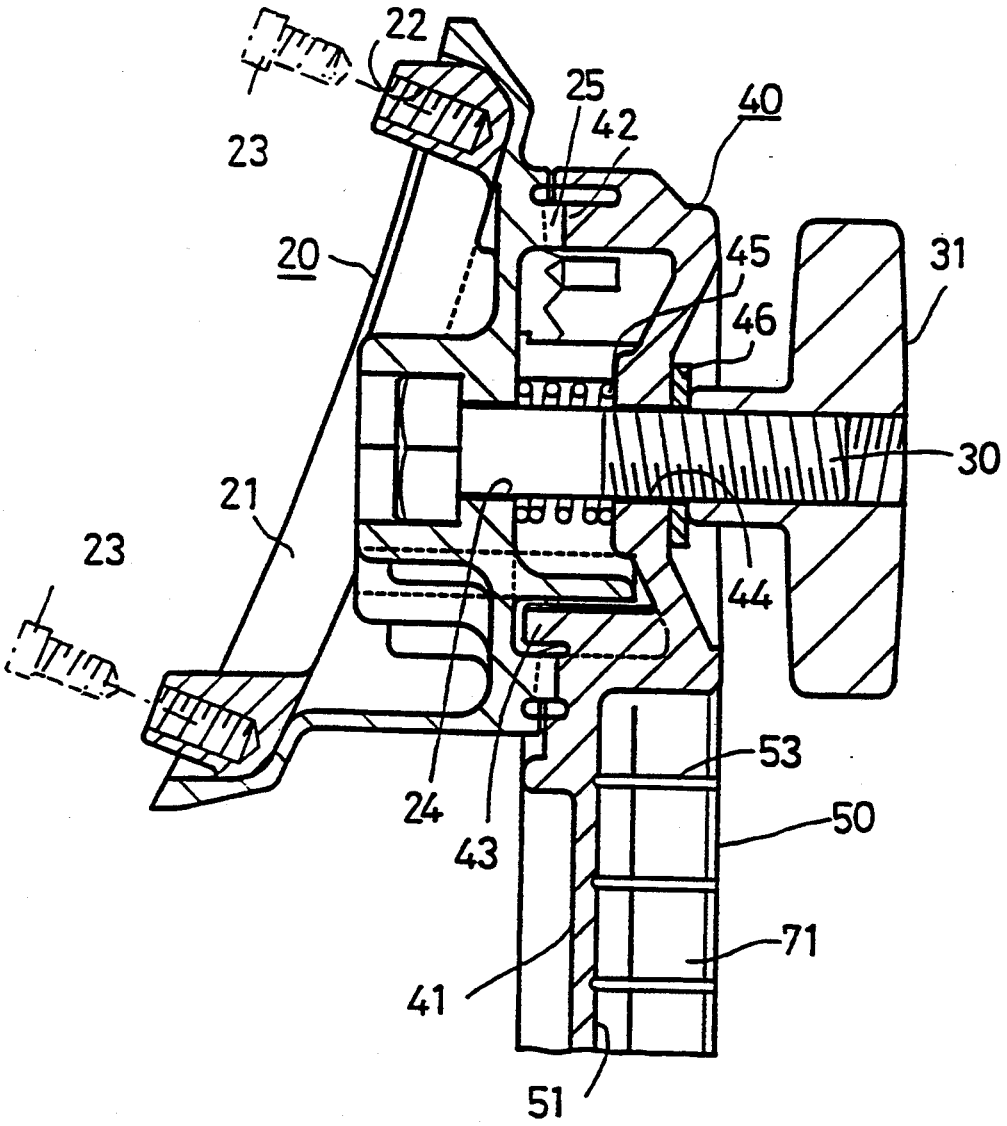
FIG. 4 is a cross section along line 4—4 in FIG. 3.

As shown in FIGS. 2 and 4, the base body 21 is fixed to the drum body 10 of the bass drum D by screws or other affixation means. The base has holes 22 enabling installation of the base on the drum body 10 by installation screws 23 which are screwed into the installation holes 22 to fix the base body 21 to the body 10 of the drum D.

A tightening bolt 30 stands up from the surface of the base body 21. The leg assembly 40, as described below, is installed in a freely rotatable fashion. There is a hole 24 in the base body 21 for insertion of the tightening bolt 30 which is held in place by a nut 31.

The annular gearing surface 25 is an annular ring around the insertion hole 24 for the tightening bolt 30. It is gear meshed with the fitting surface 42 on the leg assembly 40 to securely hold the main base body 21 to the leg assembly 40.

The first and second protrusions 26 and 27 are provided concentric with and at the inner periphery of the gearing surface 25 at a prescribed circumferential distance apart. The stopper protrusions 26 and 27 10 determine the use and storage positions of the leg assembly. In this example, the use position is set by the first stopper protrusion 26 and the storage position is determined by the second stopper protrusion 27.

Figure 5:
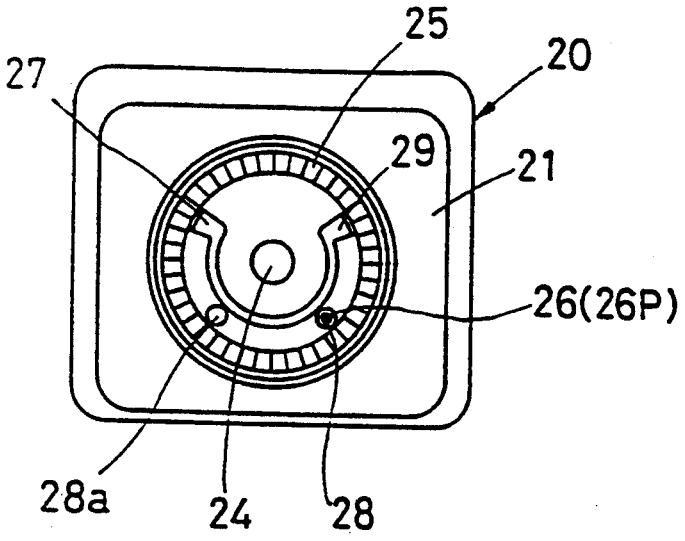
FIG. 5 is a front view of the base for the support leg.
Figure 6:
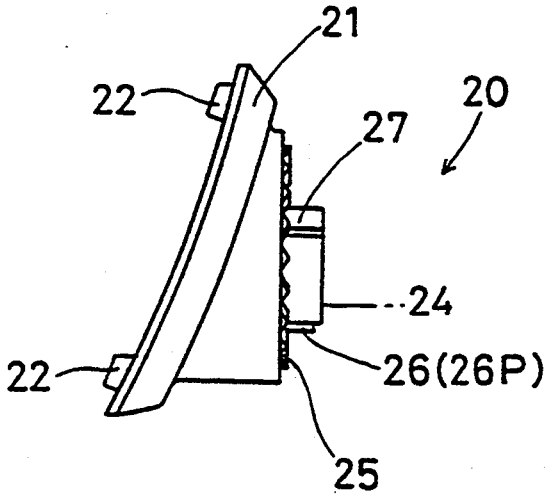
FIG. 6 is a side view of the base.

The first stopper protrusion 26 is comprised of a spring pin 26P which is inserted into a pin hole 28 in the main base body 21. In FIG. 5 pin holes 28a are provided symmetrically to the right and the left of the pin hole 28 constituting the first stopper protrusion 26, and the protrusion 29 are provided symmetrically to the right and the left of the second stopper protrusion 27 and the insertion hole 24 is at the center, so that the main base body 21 may cooperate with either the right side or the left side of the support leg.

The hole 28 and the protrusion 27 are used as the first and the second stopper protrusions of one of the support legs (e.g. the left leg), while the hole 28a and the protrusion 29 are used for the same purpose on the other support leg (e.g. the right leg). In this manner, one main base body 21 construction can be used for both the right and left sides of the main body 10 of the bass drum.

The leg assembly 40 comprises a main bar shaped body 41, a gear surface 42, a stopper 43 and a leg holding part 50, which securely holds the leg body 70 in a freely expandable and contractible manner.

Figure 3:
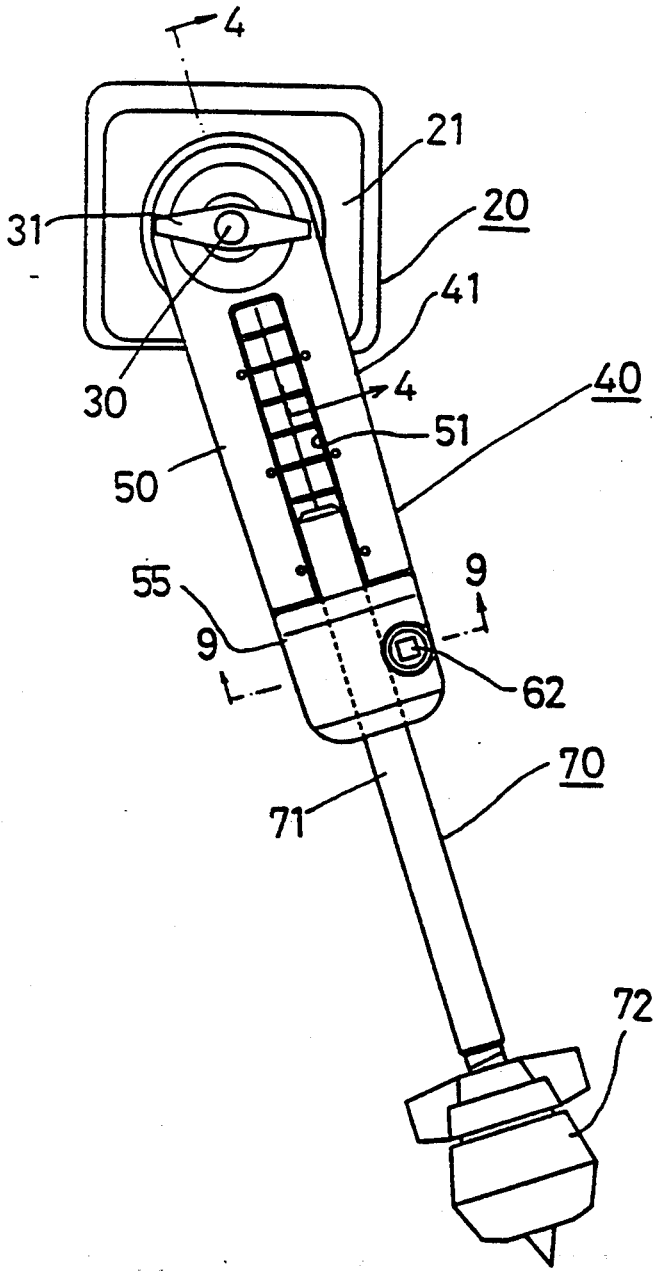
FIG. 3 is an expanded front view of the support leg.

In FIG. 3, the leg body 70 has a slide preventing rubber foot 72 at the bottom of the leg post 71 which is made of a steel pipe, etc. as shown in FIG. 3. The leg post 71 is inserted into the main bar shaped body 41 through the leg holding part 50. The length of the leg body 70 is freely adjustable and then is fixed by means of a tightening bolt 62.

As shown in FIG. 4, at the top of the main bar shaped body 41 of the leg 40 assembly, there is an insertion hole 44 for the tightening bolt 30. The tightening bolt 30 in the insertion hole 44 receives the nut 31 screwed on, which installs the leg assembly 40 and secures it on the base 20. A spring 45 normally urges the leg assembly and its surface 42 outward from the base 20 and its gearing surface 25 which enables the leg to be rotated. Tightening of the nut 31 on to the bolt 30 and against a washer 46 secures the bolt 30 against loosening.

A fitting surface 42 on the back of the upper portion of the main bar shaped body passes around the insertion hole 44. The surface 42 is comprised of a concave-convex part which is approximately round in a radial fashion and is gear meshed with the gear surface 25 of the base 20. The connection between the fitting surface 42 and the gearing surface 25 adjusts the rotation position of the leg when the bolt 30 is loosened and then fixes the leg at a selected rotation position when the bolt 30 is tightened.

Figure 8:
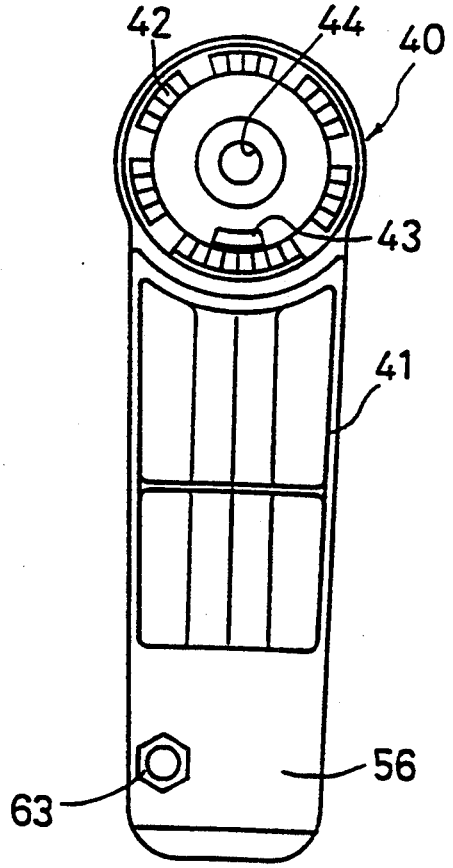
FIG. 8 show the back of the support leg attachment.

As shown in FIG. 8, the stopper 43 comprises a protrusion on the inner side of the fitting surface 42. During rotation of the leg assembly 40, the stopper 43 moves between the first and second stopper protrusions 26 and 27 on the main base body 21, and its engagement with the protrusions 26 and 27 sets the use and storage positions of the leg assembly 40.

In FIGS. 3 and 4, the leg holding part 50 is provided on one side of the main bar shaped body 41 and at the bottom of the fitting surface 42. A leg storing groove 51 extends through the leg holding part 50 in the longitudinal direction. The upper part of the leg post 71 of the leg body 70 is stored in the groove in a freely expandable and contractible manner. Just outside the side of the leg storage groove 51, there is a display 52 that is arranged along the leg storage groove 51. A display 53 inside the groove 51 displays the selected expanded or contracted position of the leg body 70. The display parts 52 and 53 are comprised of convex parts or scales which are provided at a suitable distance apart. They indicate the upper position of the leg post 71 which is stored in the leg storage groove 51, enabling coordination of the lengths of the right and left leg bodies 70. In this example, major adjustments are carried out with the display 52 and minor adjustments with the display 53.

Figure 7:
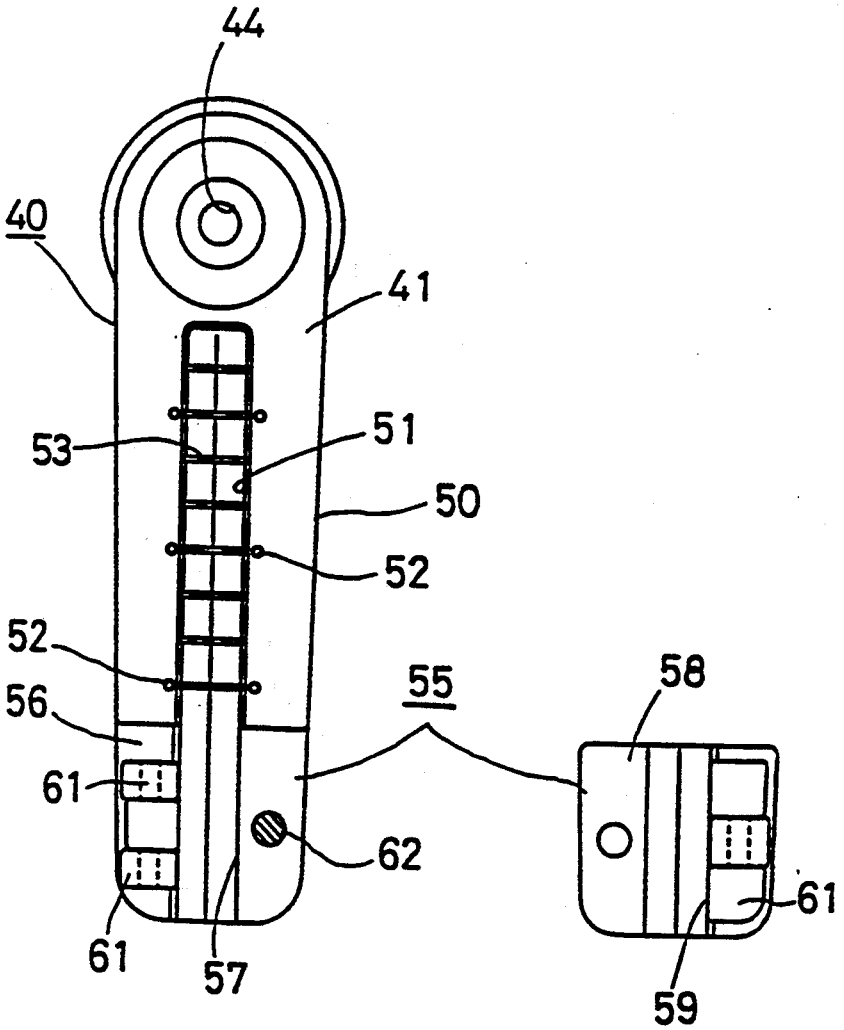
FIG. 7 is a front view of the bar shaped main body of the leg.
Figure 9:
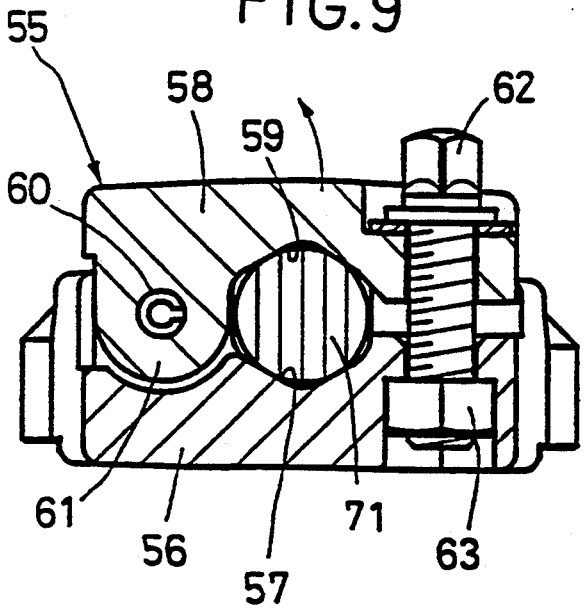
FIG. 9 is a cross section of the leg along line 9—9 in FIG. 3.

A leg length setting fixture 55 is provided at the bottom of the leg holding part 50. The fixture 55 fixes the expanded or contracted positions of the leg body 70. As is shown in FIGS. 7 and 9, the fixture comprises a fixed side holding part 56 which extends from the bottom of the leg holding part 50 and a movable side holding part 58 which is freely openable and closable with respect to the fixed side holding part 56.

A fixed side leg holding groove 57 is provided on the fixed side holding part 56. On the surface opposing the fixed side leg holding groove 57 of the moveable side holding part 58, there is a movable side leg holding groove 59. The leg post 71 is held by the holding grooves 57 and 59.

A shaft 60 on the part 56 is at a shaft holding part 61 for opening and closing the movable side holding part 58. The fixture 55 holds the main leg post 71 by means of the fixed side leg holding groove 57 and the movable side leg holding groove 59. It also tightly fixes the fixed and movable side holding parts 56 and 58 by a tightening bolt 62 and a nut 63, which fixes the leg post 71.

The mechanism for switching the use position of the support leg S with respect to the drum body and for adjusting the angle is provided on the fitting surface between the base member 20 and the leg 40. As a result that mechanism is not exposed to the outside and does not ruin the outside appearance of the bass drum D.

Figure 10:
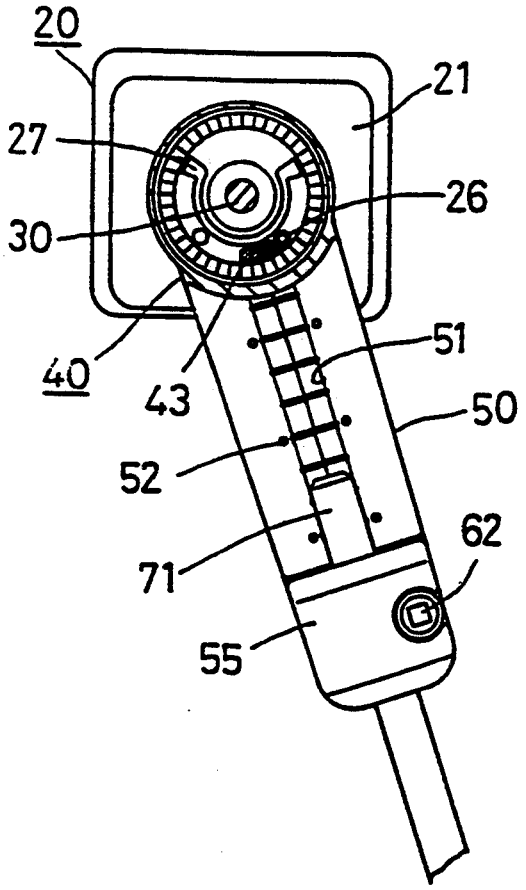
FIG. 10 is a front view in partial cross section showing the support leg in the use position.

To reposition the support leg S, the tightening nut 31 that fixes the leg assembly 40 at the base member 20 is loosened at first, and the eventually released leg assembly is rotated in the direction of the floor. As a result, the stopper 43 of the leg assembly 40 rotates as shown in FIG. 10. At the point where the stopper hits the first stopper protuberance 26, the use position of the leg is established. The tightening nut 31 is tightened, which fixes the use position of the leg assembly 40.

Next, the leg post 71 of the leg body 70, which is accommodated in the leg storage groove 51 of the leg holding part 50, is adjusted to a suitable length with reference to the displays 52 and 53 to indicate that position. Then the fixed and movable side holding parts 56 and 58 are tightened by the tightening bolt 62 and nut 63, which fixes the length of the leg post 71 which is held in the holding grooves 57 and 59.

The support leg S on the opposite side of the drum body 10 is similarly set. The other leg may be the set at the same length as the leg on the first side with a single touch by using the display 52 for measurement.

Figure 11:
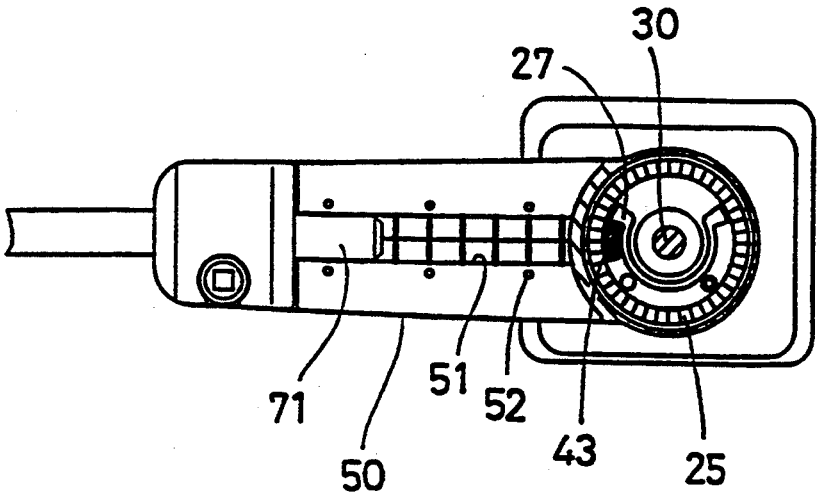
FIG. 11 is a front view showing the leg in the storage position.

To store the support leg S, the tightening nut 31 is loosened. The eventually released leg assembly 40 is rotated upward together with the leg body 70, as shown in FIG. 11. The stopper 43 of the leg assembly 40 rotates until it hits the second stopper protrusion 27 so that the direction of the support leg is switched to the storage position. As the tightening nut 31 is once again tightened, the position of the leg assembly 40 is fixed.

Figure 12:
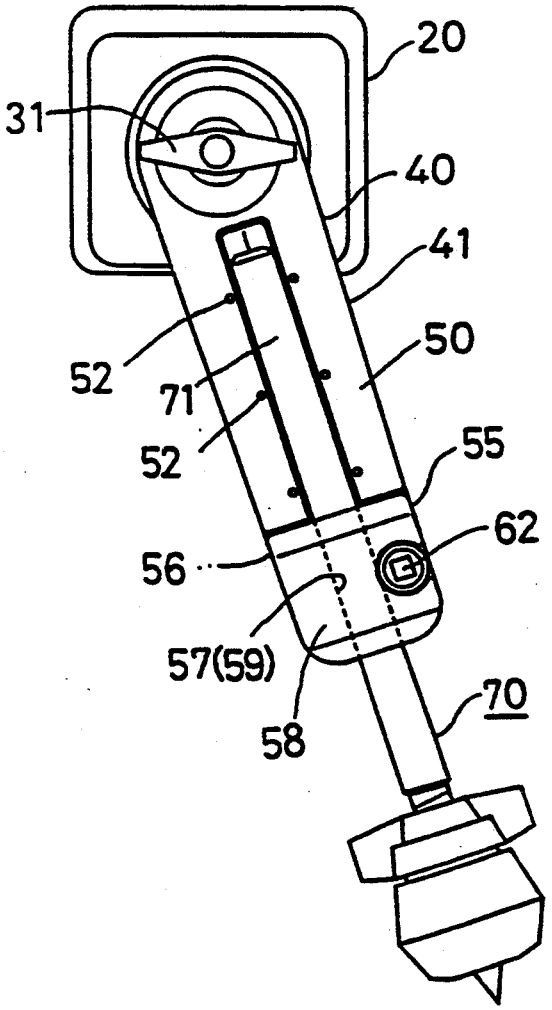
FIG. 12 is a front view showing the leg accommodated in its leg holding part.

FIG. 12 shows the leg body 70 accommodated in the leg holding part 50.

The invention enables length adjustment of both right and left support legs for a bass drum quickly and accurately, because of the display of the expanded or contracted position of the leg body. Furthermore, the mechanism for switching between the use and the stored states of the support leg is not visible from the outside, avoiding an adverse effect upon the external appearance of the bass drum.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A support leg for a musical instrument drum comprising:

a base that is fixed to a body of a drum, the base having an annular gear surface facing outwardly of the base; a first stopper on the base at a first location around the gear surface and a second stopper projecting from the base at a second location around the gear surface spaced from the first location;

a bar shaped body including an upper support part; the upper support part being supported on the base for swinging around the center of the annular gear surface on the base; meshing annular gearing on the upper part of the bar shaped body meshing with the gear surface on the base;

a stopper on the side of the bar shaped body facing in toward the base and positioned to be movable between and to abut either one or the other of the first and second stoppers on the base for defining the ends of the swinging movement of the leg, thereby for setting a first leg use and a second leg storage position with respect to the base;

a leg holder on the bar shaped body, and the leg body projecting out of the leg holder, the leg body being movable into and out of the bar shaped body for respectively contracting and expanding the length of the leg body; and the holder being adapted for securing the leg at a selected length projecting from the bar shaped body.

2. The drum support leg of claim 1, further comprising a display on at least one of the bar shaped body and the leg holder and associated with the leg which is movable with respect to the bar-shaped body for indicating the expanded and contracted position of the leg with respect to the main bar shaped body.

3. The drum support leg of claim 1, wherein the first and second stoppers are positioned within the annular region defined by the gear surface on the base.

4. The drum support leg of claim 1, further comprising means for supporting the bar shaped body to the base for permitting pivoting of the bar shaped body around the rotation center of the gear surface.

5. The drum support leg of claim 1, further comprising means for tightening the main body to the base for meshing the gear surface with the gearing.

6. The drum support leg of claim 1, further comprising means for normally urging the main body off the base and which is opposed by the tightening means.

7. A support leg for a bass drum with a drum body, comprising:

a base on the drum body; a gear surface defined on the base;

a leg assembly pivotally supported to the base at the gear surface; the leg assembly including a main body; gearing on the main body for facing in toward and for meshing with the gear surface for preventing rotation of the leg assembly with reference to the base;

cooperating stoppers on the base and the main body for establishing use and non-use pivot positions of the leg assembly with reference to the base;

the leg assembly including a leg that is adjustable between an expanded and contracted position with reference to the main body; and a display on the main body for indicating the expanded condition of the leg with respect to the main body.

8. The drum support leg of claim 7, further comprising means for tightening the main body to the base for meshing the gear surface with the gearing.

9. The drum support leg of claim 8, further comprising means for normally urging the main body off the base and which is opposed by the tightening means.

* * * * *